US005268263A

United States Patent [19]

Valentini et al.

[11] Patent Number: 5,268,263

[45] Date of Patent: Dec. 7, 1993

[54] PHOTOGRAPHIC ELEMENTS WITH IMPROVED COATING LAYERS

[75] Inventors: Jose E. Valentini, Hendersonville, N.C.; Jose M. Rodriguez-Parada, Wilmington, Del.

[73] Assignee: E. I. Du Pont de Nemours and Company, Wilmington, Del.

[21] Appl. No.: 17,161

[22] Filed: Feb. 22, 1993

[51] Int. Cl.[5] ..... G43C 1/76

[52] U.S. Cl. ..... 430/536; 430/523; 430/531; 430/537; 430/627; 430/631; 430/635

[58] Field of Search ..... 430/536, 537, 531, 523, 430/627, 631, 635

[56] References Cited

U.S. PATENT DOCUMENTS 4,229,524 10/1980 Yoneyama et al. ..... 430/536
4,440,848 4/1984 Bailey et al. ..... 430/536
4,508,764 4/1985 Zeldes ..... 427/296
4,891,306 1/1990 Yokoyama et al. ..... 430/527
4,929,666 5/1990 Schmidt et al. ..... 524/516

*Primary Examiner*—Jack P. Brammer

[57] ABSTRACT

An improved coating composition is detailed which increases the range of differential pressure within which a photographic element can be coated on a slide bead coating apparatus. The improved composition comprises a novel combination of the polymer shown in Formula 1 and the surfactant shown in Formula 2. The substituents are described.

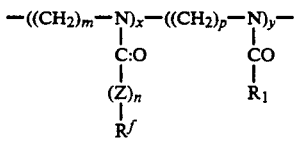

Formula 1

$A-SO_3^-X^+$.

Formula 2

9 Claims, No Drawings

PHOTOGRAPHIC ELEMENTS WITH IMPROVED COATING LAYERS

FIELD OF INVENTION

This invention relates to a photographic composition with improved coatability. More specifically, this invention relates to a specific composition of polymer and surfactant which allows for broader coating latitude as defined by an increase in the range of differential pressure on a slide bead coater.

BACKGROUND OF THE INVENTION

Coating of photographic elements has been known in the art as has the use of a slide-bead coating apparatus to accomplish the task.

Slide bead coaters are well known in the art to utilize a pressure differential on the upper and lower surfaces of the coating solution to reduce air entrapment and to facilitate the formation of a liquid bead, or bridge, between the surface of the coater and the substrate being coated.

For a given coating solution at a given coating rate the range of operative differential pressure, also known as vacuum range, is defined by an upper limit and a lower limit. Above the upper limit streaks and other defects occur which decreases the usefulness of the final product. Below the lower limit the stability of the bead degrades and the edges of the coating are drawn in towards the center of the coating which is catastrophic. It is the goal of the artisan to maintain an operating differential pressure which is between the upper and lower limits and which will not encroach on either limit when minor operational fluctuations occur.

One of the main goals of a skilled artisan is the ability to achieve higher coating rates. As the coating rate is increased the difference between the upper and lower limits of differential pressure diminishes as described in Zeldes U.S. Pat. No. 4,508,764. Due to this conflict there is an ongoing need in the art for coating compositions which can effectively increase the range of differential pressure.

SUMMARY OF THE INVENTION

An object of the present invention is to provide a photographic composition which can be coated with a higher differential pressure on a slide bead coater.

It is another object of the present invention to provide a photographic composition which can be coated at a higher rate without decreasing the effective range of differential pressure.

It is another object of the present invention to provide a coating composition which has a decreased amount of scrap material due to streaks which occur at differential pressure levels which are above the maximum allowed for the formulation.

It is a particular feature of the present invention that these and other objects, as apparent to one skilled in the art, can be accomplished with a small amount of additives as illustrated herein.

These and other advantages are provided in a coated photographic element comprising a support, a hydrophilic colloid layer on at least one side of said support wherein said hydrophilic colloid layer further comprises at least one polymer defined by Formula 1:

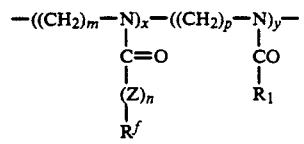

Formula 1 wherein y/x is 1 to 23;

Z is a divalent linking group represented by the formula $-(R^2)_nL-$ or $-L-(R^2)_n-$ where $R^2$ is an alkylene, arylene, or aralkylene group containing 1 to 10 carbon atoms, —L— is an —O—, —S—, $-NR^3$, —CO—, —OCO—, —SCO—, $CONR^3$—, $-SO_2-$, $-NR^3SO_2-$, $-NR^3SO_2-$, $-SO_2NR^3-$ or —SO— group; wherein $R^3$ is an alkyl group containing from to 4 carbons;

m and p independently represent an integer of 2 or 3;

n is an integer of 0 or 1;

r is an integer of 0 or 1;

$R^f$ is an alkyl, aralkyl, aryl or alkylaryl group containing 1 to 30 carbon atoms wherein at least one hydrogen atom is replaced by fluorine;

$R^1$ is an alkyl, aralkyl, aryl or alkylaryl group containing 1 to 20 carbon atoms;

said hydrophilic colloid layer further comprises at least one surfactant defined by Formula 2:

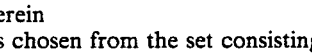

Formula 2 wherein

A is chosen from the set consisting of

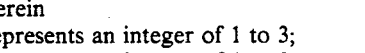

a)

wherein a represents an integer of 1 to 3;

c represents an integer of 1 to 3;

b represents an integer of 0 to 50;

d represents an integer of 0 to 50;

$R^4$ is alkyl of 2 to 20 carbons;

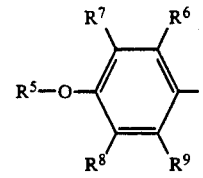

b)

wherein $R^5$ represents hydrogen, alkyl of 1 to 20 carbons, aryl of 6 to 20 carbons, or aryl of 6 to 20 carbons substituted with sulfate, nitrate, carbonate, or alkyl of 1 to 20 carbons; $R^6$, $R^7$, $R^8$, $R^9$ independently represent hydrogen or alkyl of 1 to 20 carbons; X is a cation.

DETAILED DESCRIPTION OF THE INVENTION

Compounds which are suitable for increasing the surface elasticity of a coating solution are polymerized oxazolines as represented by Formula 1 in specific combination with a surfactant as represented by Formula 2.

Compounds represented by Formula 1 are preferably added to a hydrophilic colloid layer in an amount sufficient to equal 1.00 to 40.0 mg/m$^2$ on the substrate. More preferred is a coating weight of Formula 1 sufficient to equal 2.0 mg/m$^2$ to 20.0 mg/m$^2$.

Within Formula 1 the ratio of y/x is preferably 1 to 23. Below a ratio of 1 the solubility of the polymer becomes insufficiently low to act in a manner consistent with the current invention. Above a ratio of 23 the fluorinated alkyl group represented by $R_f$ is in a concentration which is to low to sufficiently alter the surface elasticity of the hydrophilic colloid solution. Particularly preferred y/x ratios are 10 to 20. Substituent Z is a divalent linking group represented by the formula $—(R^2)_nL—$ or $—L—(R^2)_n—$ where $R^2$ is an alkylene, arylene, or aralkylene group containing 1 to 10 carbon atoms, —L— is an —O—, —S—, $—NR^3—$, —CO—, —OCO—, —SCO—, $—CONR^3—$, $—SO_2—$, $—NR^3SO_2—$, $—SO_2NR^3—$ or —SO— group; wherein $R^3$ is an alkyl group containing from 1 to 4 carbons; n is an integer of 0 or 1. $R_f$ is an alkyl, aralkyl, aryl or alkylaryl group containing 1 to 30 carbon atoms and having one or more of its hydrogen atoms replaced by fluorine. When $R_f$ contains alkyl moieties the alkyl may be straight chained or branched. Preferred is an alkyl which terminates in at least one $—CF_3$ group, and more preferred for $R_f$ is an alkyl which has all hydrogens replaced with a fluorine. $R^1$ is an alkyl, aralkyl, aryl or alkylaryl group containing 1 to 20 carbon atoms. When $R^1$ contains alkyl groups the alkyls may be straight or branched and may be substituted.

Particularly preferred oxazoline polymers are obtained when $—(Z)_n—R_f$ is chosen from the set consisting of $—CH_2CH_2C_4F_9$, $—CH_2CH_2C_6F_{13}$, $—CH_2CH_2C_8F_{17}$, $—CH_2CH_2C_{10}F_{21}$, $—CH_2C_6F_{13}$, $CH_2C_{10}F_{21}$, $—CH_2N(C_2H_5)SO_2C_6F_{13}$, $—CH_2N(C_3H_7)SO_2C_8F_{17}$, $—C_6(CF_3)_5$, and $—CH_2CH_2C_8F_{17}$; and $R_1$ is chosen from the set consisting of methyl, ethyl and propyl. The most preferred oxazoline polymer is obtained when $—(Z)_n—R$ is $CH_2CH_2C_8F_{17}$ and $R_1$ is methyl.

Surfactant compounds, represented by Formula 2, are preferably added to a hydrophilic colloid layer in an amount sufficient to equal 0.05 to 20.0 mg/m$^2$. More preferred is an amount sufficient to equal 2.0 to 5.0 mg/m2.

Within Formula 2 a preferred substituents represented by A is $—((CH_2)_a—O)_b—((CH_2)_c—O)_d—C_6H_4—R^4$ wherein a and c independently represent an integer of 1 to 3; more preferably a and c independently represent 2; b and d independently represent an integer of 0 to 50; more preferably b and d independently represent an integer of 0 to 20 and most preferably b and d independently represent 0 to 12. More preferred is a sum of b and d equal to at least 2. $R^4$ is chosen from the set consisting of alkyl of 2 to 20 carbons, more preferably 2 to 10 carbons. The term alkyl when applied to $R^4$ can be a straight chain or a branched hydrocarbon. Most preferred is an alkyl chain with a terminal tertiary butyl substituent. X is a cation chosen from the set consisting of sodium, potassium, lithium, ammonium, alkylammonium wherein alkyl contains 1 to 5 carbons, and the like.

Within Formula 2 another preferred substituent represented by A is:

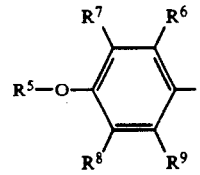

wherein $R^5$ represents hydrogen, alkyl of 1 to 20 carbons, aryl of 6 to 20 carbons, or aryl of 6 to 20 carbons substituted with sulfate, nitrate, carbonate, alkyl of 1 to 40 carbons; $R^6$, $R^7$, $R^8$, $R^9$ independently represent hydrogen or alkyl of 1 to 20 carbons.

Particularly preferred surfactants of Formula 2 are those chosen from the set consisting of:

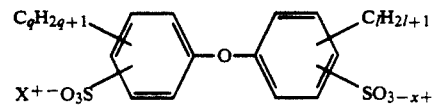

wherein X is as defined above, 1 and q independently represent integers from 0 to 40, and $$R^7C_6H_4—O(CH_2)_g—O)_h—((CH_2)_i—O)_j—SO_3X$$

wherein g and i independently represent integers of 1 to 3, most preferably 2, h and j independently represent integers of 0 to 50 and more preferably 0 to 20 and most preferably 2 to 10. It is preferable that the sum of h and j are at least equal to the integer of 2. $R^7$ is chosen from the set consisting of alkyl of 2 to 20 carbons, more preferably 2 to 10 carbons and most preferred is an alkyl with a terminal tertiary butyl group.

The most preferred surfactants of Formula 2 are $$C_9H_{19}C_6H_4O(CH_2CH_2O)_4SO_3Na$$

and

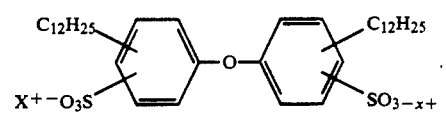

The photographic element may be any element known to the art of silver halide imaging including a photosensitive layer, an underlayer, an overcoat, or a backing layer. Most preferred is an underlayer.

A photosensitive layer typically comprises silver halide dispersed in a hydrophilic colloid binder. The silver halide is sensitized as known in the art and the layer may contain other adjuvants such as dyes, stabilizers, development agents, color coupling agents, toners, surfactants, and the like.

An underlayer typically comprises a hydrophilic colloid layer with a dye dispersed therein. The overcoat is typically coated supra to the photosensitive layer as protection from abrasion and the like and may comprise dyes or other adjuvants as known in the art.

The term "vacuum range" refers specifically to the difference between the upper limit of differential pressure and the lower limit of differential pressure. The differential pressure is applied by a vacuum chamber as known in the art and the differential pressure is usually defined as the difference between the atmospheric pressure above the solution and the pressure below the solution. The upper limit is usually referred to as the maximum differential pressure and corresponds to a gross failure characterized by regularly spaced streaks. These streaks are referred to in the art as "vacuum streaks". The lower limit is the minimum differential pressure defined by the point at which catastrophic failure occurs due to a dislocation between the edge guides and the bead. The dislocation is typically associated with a narrowing of the coating width at which point the differential pressure is completely lost due to leaks around the solution.

The term "hydrophilic colloid" or its homologue "gelatin" is used herein to refer to the protein substances which are derived from collagen. In the context of the present invention "hydrophilic colloid" also refers to substantially equivalent substances such as synthetic analogues of gelatin. Generally gelatin is classified as alkaline gelatin, acidic gelatin or enzymatic gelatin. Alkaline gelatin is obtained from the treatment of collagen with a base such as calcium hydroxide, for example. Acidic gelatin is that which is obtained from the treatment of collagen in acid such as, for example, hydrochloric acid and enzymatic gelatin is generated with a hydrolase treatment of collagen. The teachings of the present invention are not restricted to gelatin type or the molecular weight of the gelatin. It is preferable to harden or crosslink the hydrophilic colloid as know in the art.

The film support for the emulsion layers used in the novel process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. Preferred films include those formed from the polyesterification product of a dicarboxylic acid and a dihydric alcohol made according to the teachings of Alles, U.S. Pat. No. 2,779,684 and the patents referred to in the specification thereof. Other suitable supports are the polyethylene terephthalate/isophthalates of British Patent 766,290 and Canadian Patent 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al., U.S. Pat. No. 3,052,543 may also be used. The above polyester films are particularly suitable because of their dimensional stability.

The utility of the invention will now be demonstrated in the following examples. These examples are not intended to limit the invention in any way.

The oxazoline polymer (Formula 1) is prepared by the copolymerization of oxazoline monomers M-1 and M-2 corresponding to the following structures:

M-1

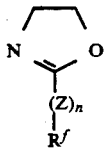

-continued

M-2

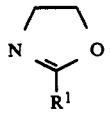

wherein Z, Rf, R1 and n are defined above. A myriad of monomers are taught in the literature. The following detailed synthetic procedures may be employed to prepare the monomers and copolymers of choice. Other synthetic procedures known to the art are also suitable.

Preparation of 2-fluorooctyl-2-oxazoline monomer

A dry 1L 4-neck round bottom flask was equipped with a thermometer, condenser, dropping funnel, nitrogen gas inlet and outlet and magnetic stirrer. Added to the flask was 186 g. of 3-(n-perfluorooctyl)propionitrile, 2.6 g of cadmium acetate and 200 ml of n-butanol. The flask was purged with nitrogen and placed in an oil bath at 120° C. Distilled ethanolamine (28.5 g) was added slowly via the dropping funnel after which the reaction was stirred for 48 hrs. The nitrogen stream was maintained throughout to remove the liberated ammonia. Solvent and excess ethanolamine were then distilled off under reduced pressure with a standard water aspirator yielding a dark brown product. The dark brown product was distilled through a vigreux column under vacuum (bp 69° C. at 15 millitorr) yielding 165 g. of a clear liquid. Further purification was accomplished by dissolving in 800 ml of chloroform and passing the solution through a column of basic alumina. Solvent removal and a second distillation yielded 157 g. of pure product. The reagent 3-(n-perfluorooctyl) propionitrile can be prepared by the reaction of $C_8F_{17}CHCH_2$ with HCN as known in the art. All other reagents are commercially available.

Preparation of Polymerization Initiator

The polymerization initiator, 3-perfluorooctylethyl-2-oxazolinium triflate, was prepared as described below. The starting material methyl trifluoromethanesulfonate is highly toxic, a possible carcinogen and corrosive. Methyl trifluoromethanesulfonate (10 g.) and anhydrous ethyl ether (100 ml.) were added to a dry 250 ml 3-neck round bottom flask equipped with a dropping funnel, magnetic stirrer and argon purge. The flask was cooled in an ice bath and 13.6 g. of 2-perfluorooctylethyl-2-oxazoline was added dropwise with vigorous stirring. A white precipitate formed immediately. After addition was complete the reaction mixture was allowed to warm to room temperature and the precipitates were filtered off under argon. The solids were washed in the filter with five 100 ml portions of ethyl ether and dried under vacuum at room temperature. 17.3 g. of product were obtained. Other commercially available initiators are also suitable such as, for example methyl p-toluenesulphonate and the like.

Co-polymerization Reaction

The solid initiator was placed in a dried 250 ml reaction kettle under inert atmosphere. The kettle was equipped with a teflon® stirring blade attached to a glass shaft and powered by an air driven motor. The monomers were added via syringe and the kettle was placed in an oil bath at 80° C. The clear reaction mixture was stirred vigorously for about 45 minutes after which the mixture became cloudy and the viscosity began to increase rapidly. After 1 hour the temperature was increased to 90° C. and stirring became increasingly difficult. After approximately 90 minutes stirring was stopped and the temperature was raised to 100° C. The solution was left at this temperature for 5 more hours to complete polymerization. After cooling to room temperature the solid polymer was dissolved in 800 ml of chloroform and precipitated into ethyl ether. The polymer settled to the bottom as a gummy solid and the ether was decanted off. The polymer was dried under vacuum at 70° C. and then ground to a fine powder. 120.9 g. of polymer were recovered.

Coating Experiments

A 5–10% by weight solution of Kind and Knox deionized gelatin was prepared in deionized water. An amount of polymer P-1 was added as indicated in the Table as was surfactant S-1.

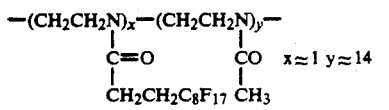

P-1

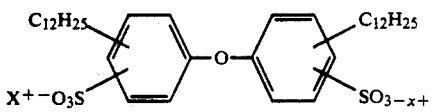

S-1

$C_9H_{19}—C_6H_4—O(CH_2CH_2O)_4—SO_3^-Na^+$ S-2

Silver halide was added in an amount sufficient to assist in the visualization of the onset of ribbing. An overcoat was prepared with conventional coating aids. The solutions were simultaneously coated onto a 13.75 cm. wide polyester support using a conventional slide bead coater. The polyester support had a previously applied gelatin subcoat to ensure wettability as known in the art. The static contact angle of the coating solutions were in the range of 18–24 degrees and the coating temperature was maintained at 40° C. with a temperature controlled slide. Bead stability was characterized by measuring the differential pressure at which flow disturbances were noticed. At reasonable coating rates, subatmospheric pressures are required under the lower meniscus to maintain a bead. Below a minimum differential pressure the edges usually contract and do not cover the entire width of the support. Above a maximum differential pressure fine lines, or ribbing, can be observed on the surface of the coating in the machine direction. The difference between minimum differential pressure and maximum differential pressure is known as the vacuum range and a larger range is advantageous since minor fluctuations in the vacuum range due to unpredictable disturbances will not cause defects.

TABLE

| Coating Rate (m/sec) | S-1 (mg/m2) | S-2 (mg/m2) | P-1 (mg/m2) | Vaccuum (in Water) | |
|---|---|---|---|---|---|
| 2.50 | 1.0 | 0.0 | 0.0 | 0.9 | x |
| 2.50 | 1.0 | 0.0 | 4.0 | 1.2 | o |
| 2.50 | 0.1 | 0.0 | 0.0 | 0.5 | x |
| 2.50 | 0.1 | 0.0 | 4.0 | 0.8 | o |
| 1.52 | 0.04 | 0.0 | 0.0 | 2.0 | x |
| 1.52 | 0.04 | 0.0 | 4.0 | 1.8 | x |
| 1.52 | 1.1 | 0.0 | 0.0 | 1.7 | x |
| 1.52 | 1.1 | 0.0 | 4.0 | 2.4 | o |
| 1.52 | 1.7 | 0.0 | 0.0 | 1.3 | x |
| 1.52 | 1.7 | 0.0 | 4.0 | 2.5 | o |
| 1.52 | 0.0 | 4.0 | 0.0 | 0.8 | x |
| 1.52 | 0.0 | 4.0 | 4.0 | 1.0 | o |
| 1.52 | 0.0 | 16.0 | 0.0 | 0.6 | x |

TABLE-continued

| Coating Rate (m/sec) | S-1 (mg/m2) | S-2 (mg/m2) | P-1 (mg/m2) | Vaccuum (in Water) | |
|---|---|---|---|---|---|
| 1.52 | 0.0 | 16.0 | 4.0 | 1.0 | o |

x = comparative
o = inventive

As illustrated in the table the combinations of polymer and surfactant which are within the teachings of the current invention provide for a wider operating window as evidenced by the increased vacuum range. The surfactant or the polymer alone decreases the vacuum range which is deleterious. The specific combination of surfactant and polymer increases the vacuum range. Levels of surfactant which are below those taught are actually shown to be detrimental to vacuum range. At higher coating rates the advantage provided is less pronounced and the vacuum range is lower than for the lower coating rate as expected.

What is claimed is:

1. A photographic element comprising a support, at least one hydrophilic colloid layer coated on at least one side of said support wherein said hydrophilic colloid layer further comprises 1.00 to 40.0 mg/m$^2$ of at least one polymer of formula

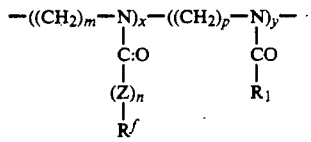

wherein y/x is 1 to 23;

Z is a divalent linking group represented by the formula $—(R^2)_rL—$ or $—L—(R^2)_r—$ where $R^2$ is an alkylene, arylene, or aralkylene group containing 1 to 10 carbon atoms, —L— is an —O—, —S—, $—NR^3$, —CO—, —OCO—, —SCO—, $CONR^3—$, $—SO_2—$, $—NR^3SO_2—$, $—SO_2NR^3—$ or —SO— group; wherein $R^3$ is an alkyl group containing from to 1 to 4 carbons;

m and p independently represent an integer of 2 or 3;

n is an integer of 0 or 1;

r is an integer of 0 or 1;

m and p independently represent an integer of 2 or 3;

$R^f$ is an alkyl, aralkyl, aryl or alkylaryl group containing 1 to 30 carbon atoms wherein at least one hydrogen atom is replaced by fluorine;

$R^1$ is an alkyl, aralkyl, aryl or alkylaryl group containing 1 to 20 carbon atoms;

said hydrophilic colloid layer further comprises 0.05 to 20 mg/m$^2$ of at least one surfactant of formula $$A—SO_3^-X^+$$

wherein

A is chosen from the set consisting of $$—((CH_2)_a—O)_b—((CH_2)_c—O)_d—C_6H_4R^4 \quad a)$$

wherein a represents an integer of 1 to 3;

c represents an integer of 1 to 3;

b represents an integer of 0 to 50;

d represents an integer of 0 to 50;

$R^4$ is alkyl of 2 to 20 carbons;

b)

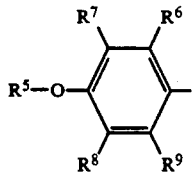

wherein $R^5$ represents hydrogen, alkyl of 1 to 20 carbons, aryl of 6 to 20 carbons, or aryl of 6 to 20 carbons substituted with sulfate, nitrate, carbonate, or alkyl of 1 to 20 carbons;

$R^6$, $R^7$, $R^8$, $^9$ independently represent hydrogen or alkyl of 1 to 20 carbons;

X is cation, wherein at least one of the hydrophilic colloid layers is a photographic emulsion layer.

2. A photographic element as recited in claim 1 wherein said polymer is present in an amount equal to 2 to 20 mg/m$^2$ and said surfactant is present in an amount equal to 2 to 5 mg/m$^2$.

3. A photographic element as recited in claim 1 wherein —(Z)n—$R_f$ is chosen from the set consisting of —$CH_2CH_2C_4F_9$, —$CH_2CH_2C_6F_{13}$, —$CH_2CH_2C_8F_{17}$, —$CH_2CH_2C_{10}F_{21}$, —$CH_2C_6F_{13}$, —$CH_2C_{10}F_{21}$, —$CH_2N(C_2H_5)SO_2C_6F_{13}$, —$CH_2N(C_3H_7)SO_2C_8F_{17}$, —$C_6(CF_3)_5$, and —$CH_2CH_2C_8F_{17}$; $R^1$ is chosen from the set consisting of methyl, ethyl and propyl.

4. A photographic element as recited in claim 1 wherein said surfactant is $$R^7C_6H_4—O(CH_2)_h—((CH_2)_i—O)_j—SO_3X$$

wherein g and i independently represent integers of 1 to 3, h and j independently represent integers of 0 to 50, $R^7$ is chosen from the set consisting of alkyl of 1 to 20 carbons.

5. A photographic element as recited in claim 4 wherein g and i represent the integer 2, h and j independently represent integers 0 to 20, $R^7$ is chosen from the set consisting of alkyl of 2 to 10 carbons.

6. A photographic element as recited in claim 5 wherein g and i represent the integer 2, h and j independently represent integers of 2 to 10, $R^7$ represents an alkyl with a terminal tertiary butyl group.

7. A photographic element as recited in claim 1 wherein said surfactant is

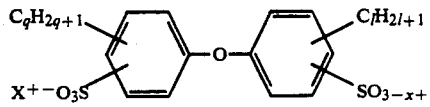

wherein

X is a cation, l represents integers from 0 to 40, q represent an integer from 0 to 40.

8. A photographic element as recited in claim 7 wherein l represents an integer from 8 to 14, and q represents an integer from 8 to 14.

9. A photographic element as recited in claim 1 wherein said polymer is

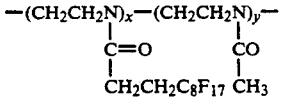

wherein x and y is 14, and said surfactant is chosen from the set consisting of

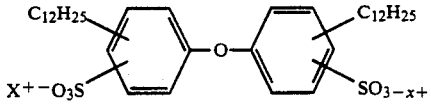

and $C_9H_{19}—C_6H_4—O(CH_2CH_2O)_4—SO_3^-Na^+$.

* * * * *